United States Patent [19]

Gentry et al.

[11] 4,388,022

[45] Jun. 14, 1983

[54] FLEXIBLE FLOWLINE BUNDLE FOR COMPLIANT RISER

[75] Inventors: Larry L. Gentry, Sunnyvale; Herbert H. Moss, Cupertino, both of Calif.; Narayana N. Panicker, Grand Prairie, Tex.; William T. Wada, Sunnyvale, Calif.; Irvin R. Yancey, Irving, Tex.

[73] Assignee: Mobil Oil Corporation, New York, N.Y.

[21] Appl. No.: 220,324

[22] Filed: Dec. 29, 1980

[51] Int. Cl.[3] ..... F16L 1/04; B63B 35/00

[52] U.S. Cl. ..... 405/195; 166/350

[58] Field of Search ..... 405/169, 195; 166/345, 166/350, 359, 366, 367

[56] References Cited

U.S. PATENT DOCUMENTS

| | | | |
|---|---|---|---|
| 3,324,943 | 6/1967 | Price | 166/359 X |
| 3,791,442 | 2/1974 | Watkins | 166/359 X |
| 3,911,688 | 10/1975 | Behar et al. | 166/350 X |
| 4,182,584 | 1/1980 | Panicker et al. | 405/195 |
| 4,194,568 | 3/1980 | Buresi et al. | 166/359 X |

*Primary Examiner*—David H. Corbin

*Attorney, Agent, or Firm*—C. A. Huggett; M. G. Gilman; L. G. Wise

[57] ABSTRACT

A marine compliant riser system connects a subsea hydrocarbon source to a floating surface facility through a lower multi-conduit riser section to a submerged buoy section located below a turbulent water zone and a flexible flowline. Fluid connection is established between corresponding lower riser conduits and the surface facility by a plurality of flexible conduits. Connection assembly means connects individual upwardly-directed flexible conduits with corresponding upwardly-directed lower riser conduits in fluid flow relationship. A yoke assembly mounted on the buoy section, includes beam means for holding a plurality of spaced apart flexible conduit terminations, with each of the flexible conduits being connected individually in catenary arrangement between the yoke assembly and the surface facility. The flexible conduits are attached to the surface facility in compact, non-linear array and to the yoke assembly in substantially linear array. A ribbon-like configuration is obtained by providing a plurality of spreader beams spaced longitudinally along the flexible flowline at predetermined locations, each of the spreader beams having annular conduit guide means mounted on the beam in laterally-spaced linear array for restraining the conduits from side movement while permitting longitudinal movement of individual conduits axially with the flowline.

12 Claims, 16 Drawing Figures

FLEXIBLE FLOWLINE BUNDLE FOR COMPLIANT RISER

BACKGROUND OF THE INVENTION

This invention relates to a marine riser system having flexible flowlines. In particular, it relates to apparatus for connecting a surface facility to a subsea wellhead or gathering system.

In the production of fluid hydrocarbons from deep-water marine oil and gas deposits, a fluid communication system from the marine bottom to the surface after production is required. Such a system, commonly called a production riser, usually includes multiple conduits through which various produced fluids are transported to and from the surface, including oil and gas production lines, service and hydraulic control lines.

In many offshore production areas, a floating facility can be used as a production and/or storage platform. Since the facility is exposed to surface and sub-surface conditions, it undergoes a variety of movements. In such a zone of turbulence, heave, roll, pitch, drift, etc., may be caused by surface and near surface conditions. In order for a production riser system to function adequately with such a facility, it must be sufficiently compliant to compensate for such movements over long periods of operation without failure.

Such a marine riser is disclosed in U.S. Pat. No. 4,182,584. This compliant riser system includes (1) a lower section which extends from the marine bottom to a fixed position just below the zone of turbulence that exists near the surface of the water, and (2) a flexible section which is comprised of flexible flowlines that extend from the top of the rigid section, through the turbulent zone, to a floating vessel on the surface. A submerged buoy is attached to the top of the rigid section to maintain the rigid section in a substantially vertical position within the water. With riser systems of this type difficulties often arise in installing and maintaining the flexible conduits. Often the flexible flowline is attached to a rigid section such that the end portion adjacent the fixed or rigid portion is not attached at a normal catenary departure angle. This can result in localized stresses, causing undue wear in the flexible flowline at its terminal hardware. If a natural catenary shape is assumed by the flowline, it approaches the fixed position section pointed upwardly, nearly vertical at its point of suspension.

In a compliant riser system for deep oceanic location, a need exists for linking the surface facility to the submerged lower riser section in a manner which provides (1) lateral excursion and rotational weathervaning of a floating vessel, (2) vertical compliance for waves and tidal conditions, and (3) disconnect and repair facilities. Due to the significant weight and pressure conditions of certain flowlines, especially large petroleum-carrying conduits, each flexible flowline member can advantageously be supported in a catenary configuration between a fixed-position buoy and the surface facility. While certain advantages adhere to multiple flexible conduits of equal length, the severe environmental and operational conditions can cause tangling or chafing of the catenary flowlines, hydraulic lines, etc.

Various attempts have been made to overcome these problems, e.g., retainers to spread and hold apart the individual flexible members; however, twisting and unequal connection stresses have caused significant problems in maintaining a reliable system.

It is an object of the present invention to provide an effective compliant riser system having a flexible flowline bundle. A particular achievement is the provision of a multi-conduit catenary bundle which can be connected compactly at one end to a rotary member on the marine surface and at the opposite end to corresponding riser conduits at the riser buoy section.

SUMMARY OF THE INVENTION

It has been found that plural flexible flowline members can be connected in a coherent bundle arrangement to provide a ribbon-like catenary arrangement which connects flexible conduits between a compact radial array at the surface facility and a linear array at the buoy connection point. The compact array of surface connections is advantageous for production vessels or floating platforms which have a horizontally-rotary member, such as a vessel moonpool plug with a vertical axis of rotation and circular cross section. Various geometric shapes—cylinders, frustro-conical configurations or partial spheroids—can be adapted to the inventive concept. For exemplary purposes, a cylindrical moonpool plug is shown, with a radial array of connection points therein. The surface facility is provided with drive means for maintaining the rotary member at a predetermined azimuth, usually ±45° from a vertical plane extending from the surface connection to the submerged buoy location.

In a preferred embodiment, the marine compliant riser system has catenary flexible flowline bundle connected between a surface facility and a submerged lower riser section. The flexible flowline bundle has means for attaching a plurality of flexible conduits at a bottom portion of the surface facility for rotation relative to the surface facility, the conduits being attached thereto at radially disposed spaced attachment points and depending therefrom at a substantially vertical catenary angle of departure. In order to achieve separation and positional control of multiple component bundles, a plurality of spreader beams adapted for holding the flexible conduits in parallel spaced-apart relationship and comprising guide means for loosely retaining each of said flexible conduits in substantially linear array while permitting longitudinal movement, thus minimizing tangling and chafing. To assure a linear array throughout a major portion of the bundle means are provided for maintaining the spreader beams longitudinally spaced along the flowline bundle. A yoke assembly can be employed to connect the parallel-spaced conduits at a substantially vertical catenary departure angle to corresponding points on submerged rigid riser section in linear array to establish fluid communication through the rigid riser section and flexible flowline.

The apparatus and installation methods are particularly advantageous in providing multiple flowline compliant risers which are individually supported in a relatively unstressed position. These and other advantages and features will be seen in the following drawing and description of preferred embodiments.

THE DRAWING

DESCRIPTION OF THE PREFERRED EMBODIMENTS

In the following explanation of the invention concept, certain portions of the overall compliant riser system are shown by example merely to illustrate a typical operative embodiment. However, modifications and variations can be made within the scope of the invention. For instance, the surface facility need not be a production vessel, semi-submersible units or floating platforms being viable alternative structures for use with compliant risers, as shown in U.S. Pat. No. 4,098,333. Likewise, the specific structure of the marine bottom connection may be adapted for single wellheads, multi-well gathering and production systems and/or manifolds for receiving and handling oil and gas. Submerged, free-standing lower riser sections need not be rigid conduits, since buoy-tensioned flexible tubing or hoses can be maintained in fixed position when attached to the ocean floor, as shown in U.S. Pat. No. 3,911,688 and French Pat. No. 2,370,219 (Coflexip). Limited excursion of the lower riser section is permissible, but the catenary upper section is relied upon to permit significant horizontal excursion and elevational changes in the surface facility.

Figure 1:
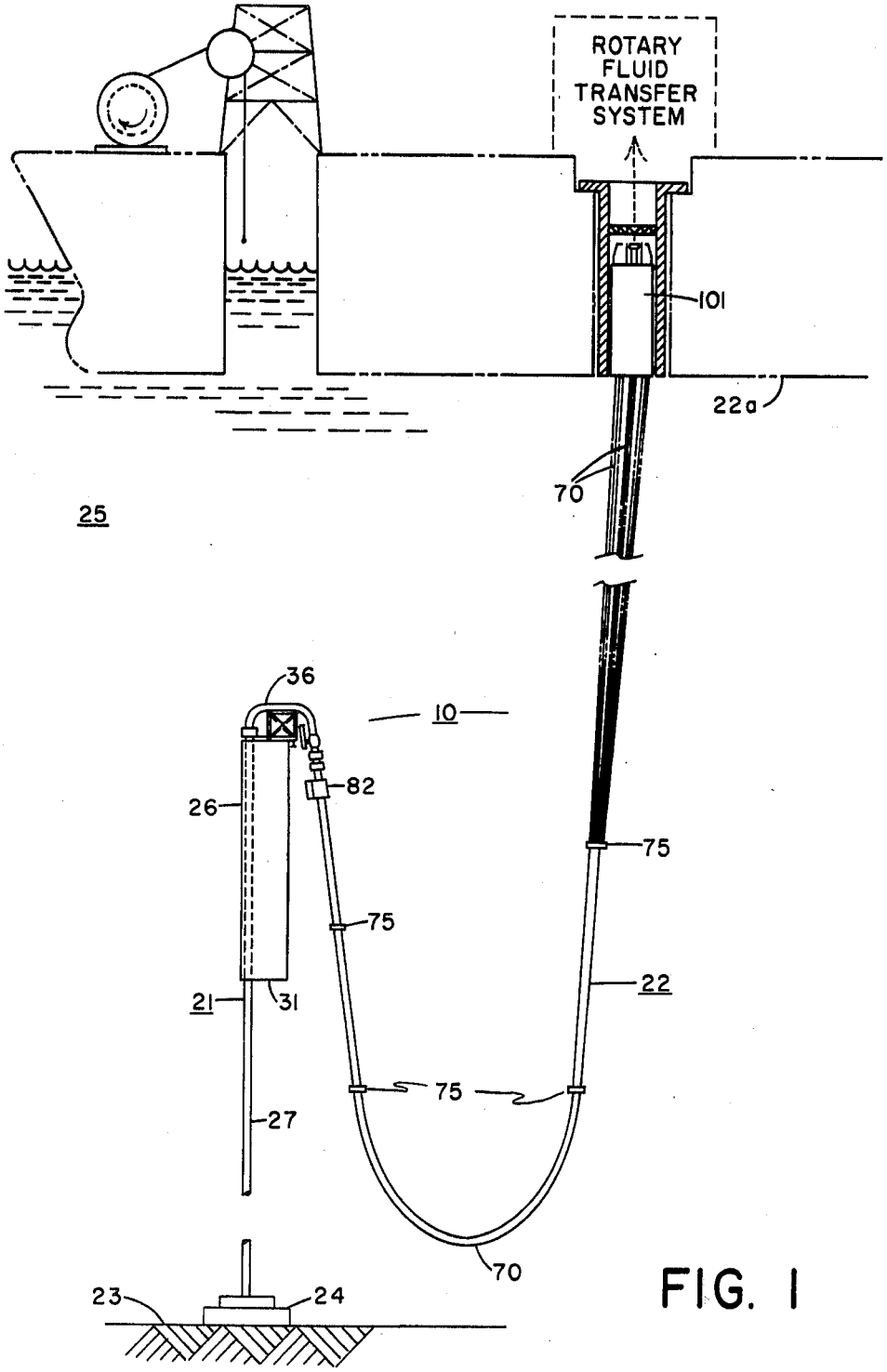
FIG. 1 is a schematic representation of a marine riser system, with a side view of a floating vessel and subsea components.

Referring now to the drawings, FIG. 1 discloses marine compliant riser system 10 in an operational position at an offshore location. The riser system has a lower rigid section 21 and an upper flexible section 22. Lower rigid section 21 is affixed to base 24 on marine bottom 23 and extends upwardly to a point just below turbulent zone 25, which is that zone of water below the surface which is normally affected by surface conditions, e.g. currents, surface winds, waves, etc. Buoy section 26 is positioned at the top of rigid section 21 to maintain rigid section 21 in a vertical position under tension. Flexible section 22 has a plurality of flexible conduits which are operatively connected to respective flow passages in rigid section 21 at buoy section 26. Flexible section 22 extends downwardly from buoy section 26 through a catenary path before extending upwardly to the surface, where it is connected to the floating facility 22*a*.

Figure 2:
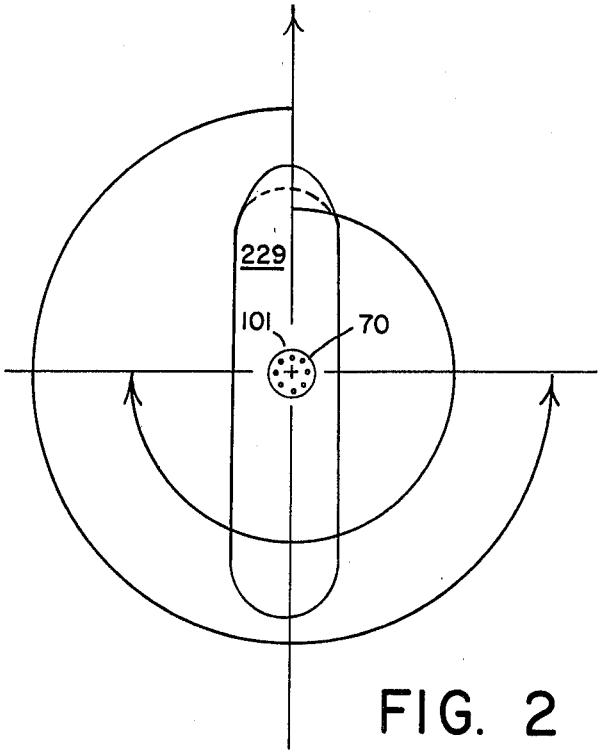
FIG. 2 is a plan view of a weathervaning surface vessel showing rotational changes and a rotary moonpool with radial array of flowlines.

The catenary flowline configuration permits safe fluid transport even though there is considerable variation of the surface vessel position relative to the fixed position riser section. Variations in rotational attitude during weathervaning of a production vessel can be compensated by having a rotary moonpool plug 101, as shown in FIGS. 1 and 2. By providing a rotary fluid transfer sub-system aboard ship to permit fluid coupling throughout an arc of 270°, for example, the surface end of flowline bundle 22 can be stabilized at a relatively fixed attitude. The surface facility also undergoes lateral surface excursion toward and away from the lower riser position, for instance, an equivalent length of up to ½ the total flexible section overall length. Ordinarily the surface facility should be capable of safe operation throughout an azimuth of ±45°. This operational sector or "watch circle" can be accommodated with the present compliant riser system, while maintaining acceptable stress distribution throughout the submerged connection subsystems.

The catenary departure angle of the flowline bundle increases as the surface vessel excursion from the lower riser section increases. Of course, a vessel moored directly over the rigid riser will have its flowlines disposed at a vertical angle (essentially 0° departure). In a typical system where the flexible hose length is three times (3×) the riser connection depth (L), as the excursion increases from 0 to 1½L, the normal catenary angle increases to about 20°.

LOWER RIGID SECTION

As shown in FIG. 1, base portion 24 is positioned on the marine bottom and submerged flowlines from individual wells may be completed thereto. Base 24 may be a wellhead, multi-well completion template, a submerged manifold center, or a like subsea structure. Each submerged flowline terminates on base 24 and preferably has a remote connector, e.g., "stab-in" connector, attached to lower end thereof. As illustrated in FIGS. 1 and 3 to 6, lower section 21 may be constructed with a casing 27, which has a connector assembly (not shown) on its lower end which in turn is adapted to mate with mounting means on base 24 to secure casing 27 to base 24.

Figure 3:
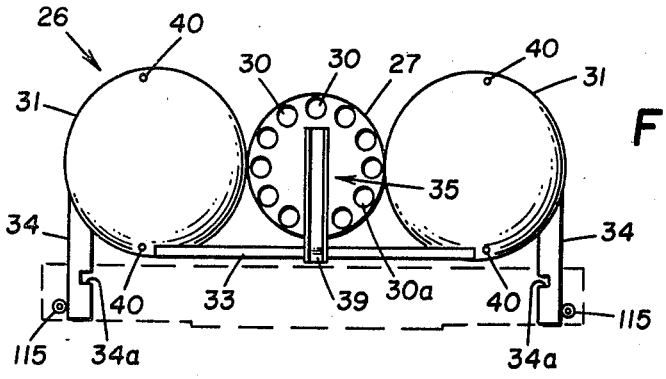
FIG. 3 is a plan view of the buoy portion, with a top connection portion removed.

As shown in FIG. 3, a plurality of individual rigid flowlines or conduits 30, which may be of the same or diverse diameters, are run through guides within or externally attached to casing 27 in a known manner. These are attached via stab-in or screw-in connectors of the submerged flowlines on base 24, providing individual flowpaths from marine bottom 23 to a point adjacent the buoy means at the top of casing 27.

RISER BUOY SECTION SUBSYSTEM

Figure 4:
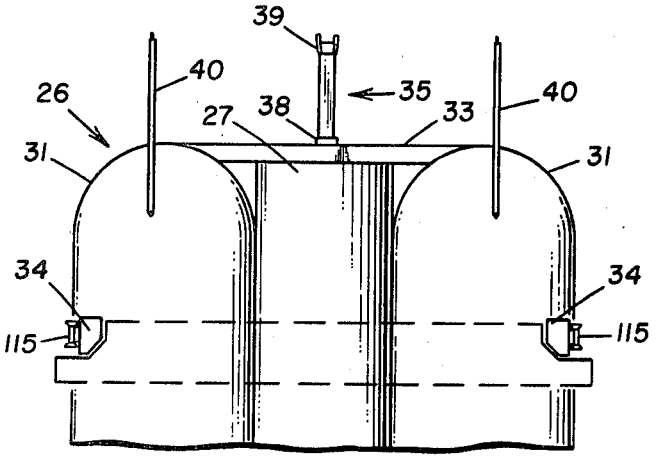
FIG. 4 is a side elevation view of the buoy portion, showing the relationship of the yoke beam in dashed line.

Located at the top of casing 27 is buoy section 26 which is comprised of multiple buoyant chambers 31, affixed diametrically opposite at either side of casing 27. As shown in FIGS. 3 and 4, beam 33 extends between chambers 31 near their upper ends and is attached thereto. Yoke-receiving lateral support arms 34 are attached to the outboard edges of chambers 31 and extend horizontally outward therefrom. Between the main buoy structure and the end of each support arm 34 is provided a slot 34*a* or knotched portion cut on the inside edge of the arm member. These slots are adapted to support a spanning dual-transmitting member of the yoke assembly as hereinafter described.

Figure 6:
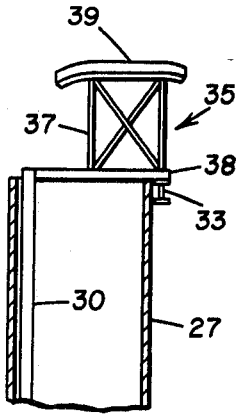
FIG. 6 is a vertical cross-section view of a typical buoy.
Figure 5:
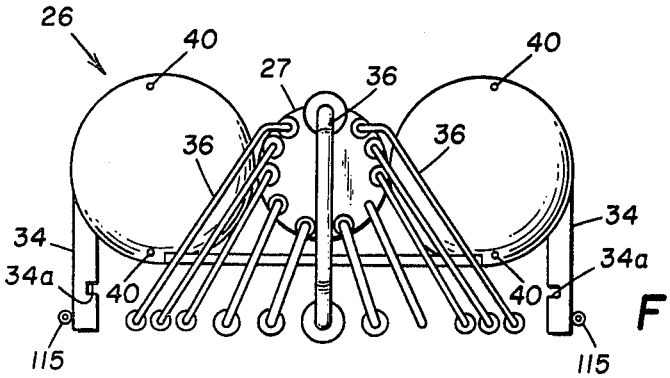
FIG. 5 is a plan view of the buoy section with a top connection assembly attached.
Figure 10:
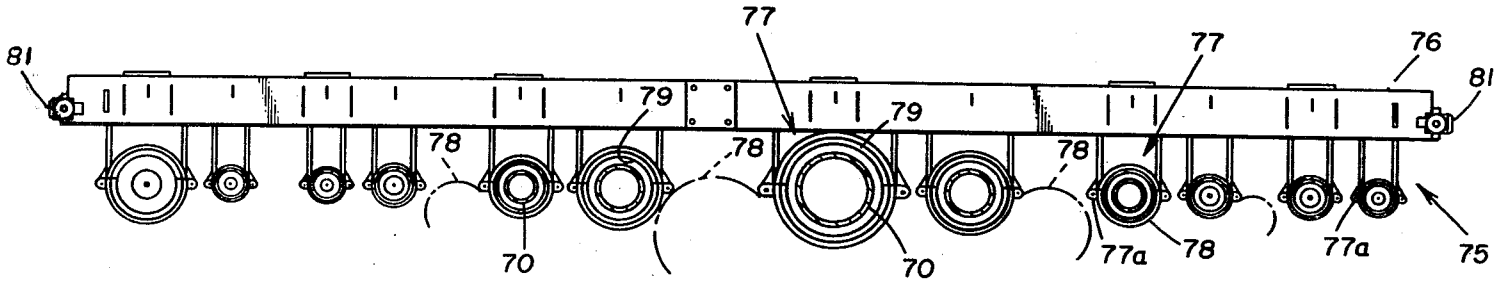
FIG. 10 is a cross-section view of the flexible flowline bundle showing the spreader beam in plan view.
Figure 9:
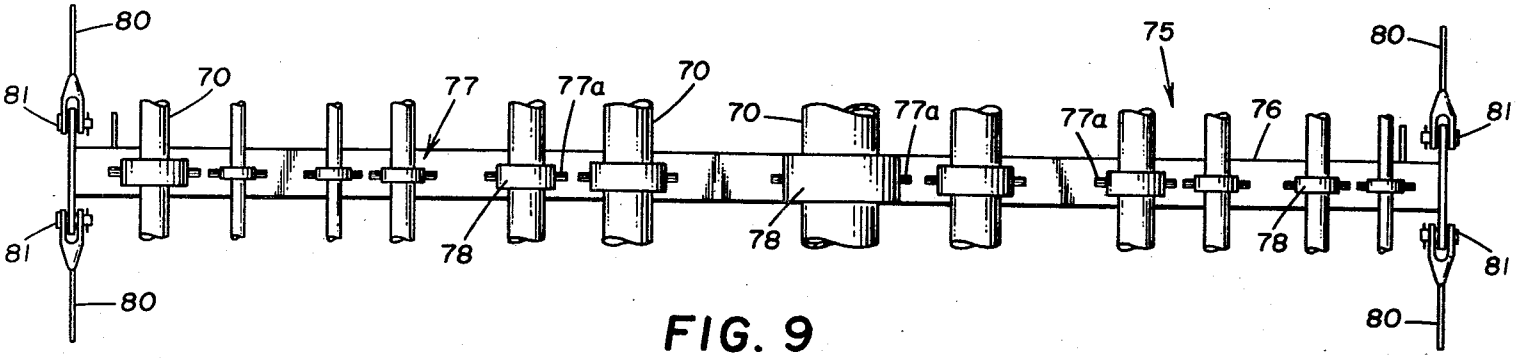
FIG. 9 is an elevation view of a portion of the flexible flowline bundle and spreader beam.

Mounted atop casing 27 and affixed to beam 33 on the buoy means are a plurality of support structures 35 for retaining inverted U-shaped connection assemblies. Although, for the sake of clarity, only one such support structure 35 is shown in FIGS. 3, 4, and 6 of the drawings, it should be understood that the overall support means includes a similar support structure 35 for each rigid conduit 30 within casing 27. Referring to FIG. 5, a typical support structure 35 is comprised of a vertical frame 37 having a lower mounting element 38 affixed to buoy beam 33 and having a trough 39 secured along its upper surface. Trough 39 is sufficiently large to receive a corresponding U-shaped or "gooseneck" conduit 36. Guide posts 40 are attached to buoyant chambers 31 and extend upward therefrom (as shown in FIGS. 3, 4 and 5) to facilitate installation of the connection assemblies.

Figure 7:
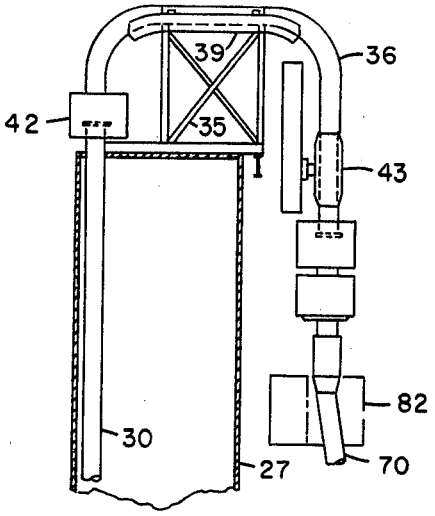
FIG. 7 is a detail side view, partially cut away of a buoy section with a connection assembly for receiving a flexible flowline.
Figure 8:
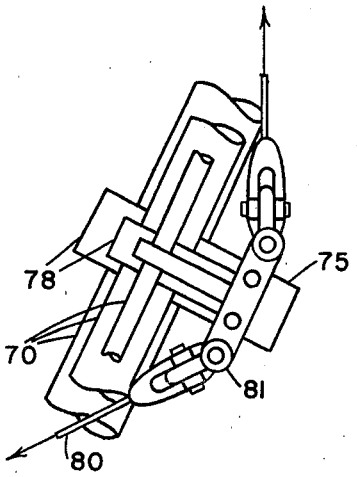
FIG. 8 is a side view of a segment of a typical flowline bundle, showing an end view of a spreader beam with support wires attached.

A typical connection assembly including gooseneck conduit 36 is shown in FIGS. 1 and 7. Gooseneck conduit 36 is comprised of a length of a rigid conduit which is curved downward at both ends to provide an inverted U-shaped flow path. Connector means 42 (e.g. hydraulically-actuated collet connector) is attached to one end of a rigid conduit and is adapted to couple this conduit fluidly to its respective lower riser conduit 30 when gooseneck 36 is lowered into an operable position. The extreme environmental conditions of subsea handling systems may cause frequent equipment failures and repair problems. In order to minimize pollution and loss of product, fail-safe valves are usually employed for all flowlines. Redundant connectors and hydraulic operators are also desirable because of occasional equipment failures. Emergency shut-off valve means may be provided in the gooseneck conduit just above its male end.

FLEXIBLE FLOWLINE SECTION SUBSYSTEM

The compliant conduit section 22 shown in FIGS. 1 and 8 to 10 comprises a plurality of flexible catenary flowlines 70, each adapted to be operatively connected between the surface facility and its respective gooseneck conduit 36 on buoy section 26. The upper end of each flexible flow conduit 70 is attached at 101 to floating facility 22*a* by any suitable means. The preferred flexible flowlines are Coflexip multi-layered sheathed conduits. These are round conduits having a protective outer cover of low-friction material. The flowlines are commercially available in a variety of sizes and may be provided with releasable ends. The ribbon-type flowline bundle restrains the flexible conduits from substantial intercontact and provides sufficient clearance at the spreader beam guides 78 to permit unhindered longitudinal movement. Flexible conduits 70 may be retained in parallel alignment or "ribbon" relationship substantially throughout their entire length. Multiple conduits of equal length can be held in this parallel relationship by a plurality of transverse spreader beams 75 longitudinally spaced along flexible conduits 70 (four shown in FIG. 1). In a preferred embodiment the surface end of the flowline bundle is connected to a rotary moonpool plug 101 on a surface vessel 22*a*, with the individual conduits 70 being arranged in a compact, non-linear array, and as a circle (FIG. 2). Typically, in arranging the flexible conduit on the ribbon-type flowline bundle, the larger, stiffer conduits are placed near the center of the bundle and smaller elements near the peripheral portions. It is preferred that nearly equal weight and hose sizes be placed in symmetrical array in order to give a balanced bundle. This arrangement also provides the least complex attachment to the buoy sections. Preferably the spreaders have individually-operable conduit guides 78 permitting removal and insertion of individual conduits.

The spreader guides may comprise annular openable means for loosely retaining corresponding conduits and having an inside diameter permitting clearance of the respective conduits. These conduits may have terminal connection means for attachment to the yoke assembly, with the connection means being sufficiently small to permit pulling through the spreader guide means. The spacing of spreader beams 75 may be defined as a function of overall flexible flowline length (L). The first spreader is located about $\frac{1}{4}$L to $\frac{1}{3}$L from the surface facility connection point, permitting adequate unconstrained length in which the bundle can be rearranged from a circular pattern to a linear pattern. The remaining spreaders may be spaced longitudinally much closer to maintain the ribbon configuration, typically from 1/10L to $\frac{1}{8}$L; however, it is understood that exact spreader spacing depends upon the number of spacers employed, length to width ratio (L:W), rigidity of the bundle, etc. Spreader beams 75 are held by beam-end wires 80 attached to the surface facility and the yoke assembly mounted at a top portion of the rigid riser section, whereby the wires support substantially only the spreader means while permitting the flexible conduits to assume a catenary shape. The spreader beam support wires can be adapted to several design situations. The individual beams may be quite heavy in the water, requiring substantial support from the wires. Spreader beams of small negative or positive buoyancy may require little support relying on the longitudinal wires largely for maintaining their spacing. Where significant non-buoyed weight must be supported, however, these wires should be designed for adequate strength.

YOKE ASSEMBLY SUBSYSTEMS

Figure 11:
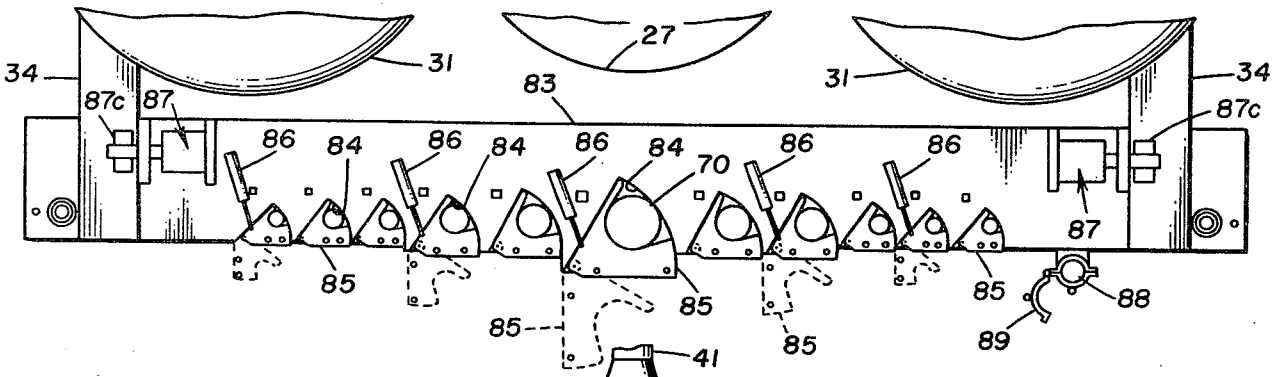
FIG. 11 is a detailed plan view of a yoke assembly for connecting the flexible section to the buoy section.
Figure 12:
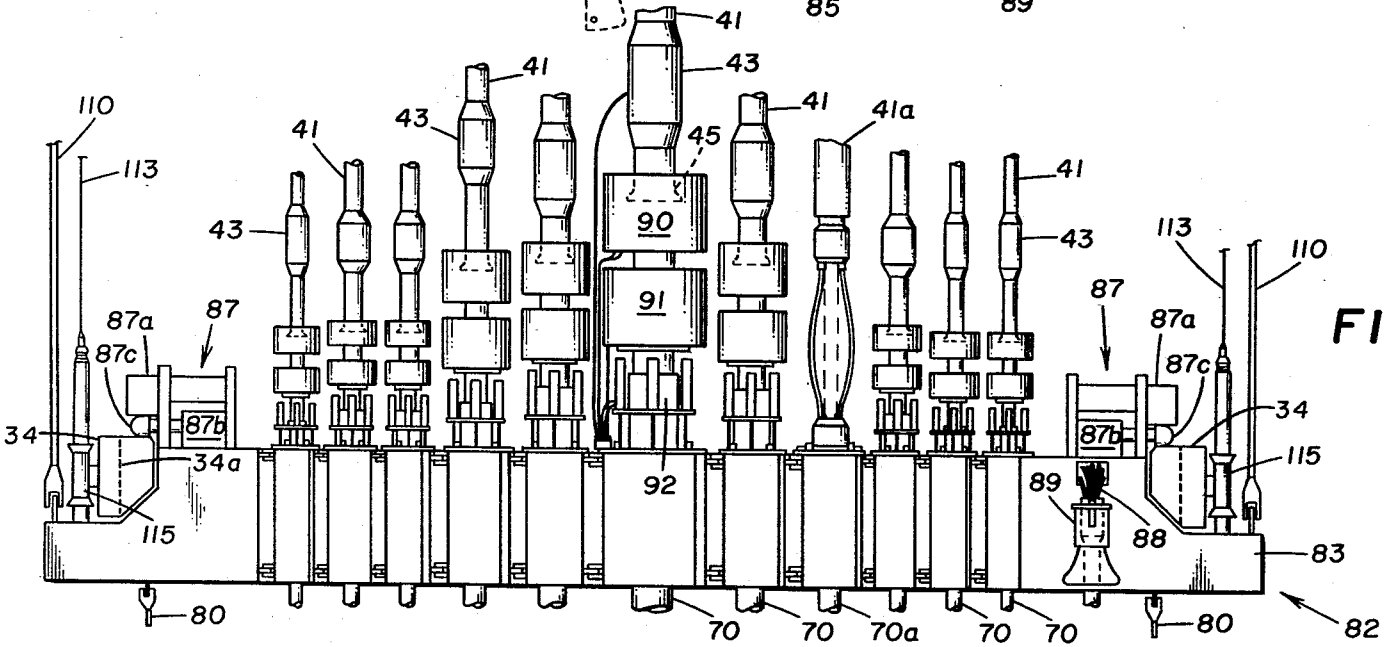
FIG. 12 is an elevation view of the novel yoke assembly, showing the connecting means for establishing fluid communication between the flexible section and connection assemblies.

Yoke assembly 82 (FIGS. 11 and 12) provides means for mounting and connecting flexible conduit section 22 to buoy section 26. Yoke assembly 82 includes an elongated horizontal support member 83. This member may be a hollow steel box beam having a plurality of spaced-apart recesses 84 therein, which receive corresponding flexible flowlines 70 in linear array at horizontally spaced locations. Loading and locking means, such as gates 85 pivotally mounted at recesses 84, secure the terminations of flowlines 70 to the yoke. Hydraulic cylinders 86 actuate gates 85 laterally between an open position (dotted lines in FIG. 11) and a closed locking position. Hydraulic cylinders 86 may be permanently attached on yoke support beam 83 or releasably mounted to be installed by a diver when needed.

Hydraulically-actuated connecting pin assemblies 87 are mounted at opposing ends of support element 83 and are adapted to support and lock the horizontal yoke support 83 to yoke arms 34 when yoke assembly 82 is in position at buoy section 26. The yoke assembly 82 is attached to the support arms 34 of the fixed riser section with releasable beam end support means 87 located at opposite ends of the yoke beam 83. This retractable attachment means has opposing retractable members 87*c* adapted to be retained adjacent arm slots 34*a* in spanning relationship. A D-shaped bar configuration and end mating arrangement between the yoke beam ends and support arms 34 permits the entire yoke assembly to fall away from the buoy section, thereby preventing angular distortion and damage to the flexible bundle in the event of attachment means failure or single retraction.

The yoke assembly may be attached initially to the fixed riser section support arms 34 by supporting the yoke, with or without the flowlines 70 attached, on cables 110. The yoke assembly is maneuvered under the support arms 34 along side the buoy section 26 and guided upwardly by guidelines 113 until the lower guide member is drawn into guide shoes 115, which prevent lateral movement of the yoke assembly relative to the support arms. The laterally-projecting beam extension member 87*a* passes through waiting slots 34*a*. Hydraulically operated reversible power means 87*b* pushes the retractable pin means 87*c* outwardly between the beam extension 87*c* and the support arms 34 to lock the yoke assembly onto the fixed riser section.

Hydraulic line 88 includes a number of individually pressurized conduits for actuating the various mechanisms on yoke assembly 82 and may be attached by means of manual gate 89.

A primary connector 90 (e.g. hydraulically-actuated collet connector) may be mounted on the end of each flexible conduit 70 and adapted to connect flexible conduit 70 remotely to male end 45 of a corresponding gooseneck conduit 41. To assure release of the flexible conduit from buoy section 26 in an emergency situation, an optional back-up or secondary redundant fluid connector 91 may be installed adjacent primary connector 90. Jackmeans 92 (FIG. 12) are then actuated to move individual flowline connectors 90 into engagement with respective male ends 45 of rigid conduits 36. Connector 90 is closed to secure the connection between conduit 36 and flexible conduit 70. Diver D then makes up the electrical connection between cables 41*a* and 70*a* to complete the installation.

INSTALLATION AND OPERATION

To install the compliant riser system 20 of the present invention, lower rigid section 27 with buoy section 26 in place is installed on base 24. Rigid conduits 30 are run into casing 27 and coupled to submerged flowlines on base 24. U.S. Pat. No. 4,182,584 illustrates a technique which can be used to install rigid section 27 and rigid conduits 30. The connection assemblies are lowered on running tools into predetermined positions on buoy section 26. The gooseneck conduit 36 of each connection assembly is positioned so that it will be properly aligned with its respective rigid and flexible conduits.

Referring to FIGS. 13A–13D; one technique for assembling and installing flexible section 22 is disclosed. Flexible conduits 70 and electrical cable 70*a* are stored on powered reels on vessel 22*a*. One end of each flexible conduit 70 and electrical cable 70*a* is connected to a plug 101 which is lowered upside down through moonpool A of vessel 22*a*. By means of line 102, plug 101 can be keelhauled between moonpool A and moonpool B. Alternatively, the moonpool plug or a portion thereof can be pre-installed, with the flexible lines being keelhauled individually and attached. Cables or wires 80 which support spreader beams 75 may be attached to plug 101 and payed out with conduits 70. Spreader beams are assembled onto conduits 70 as they are payed out or each conduit 70 can be separately positioned in its respective guide 77 on beam 75 by a diver after each beam 75 enters in the water. After the plug 100 and/or flexible lines 70 are keelhauled toward moonpool B, yoke assembly 82 can be mounted on the ends of conduits 70 and electrical cables 70*a* as shown in FIGS. 13A–13D.

Figure 13D:
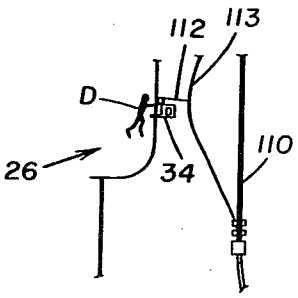
FIGS. 13A to 13D are a schematic representation of a typical installation sequence for the compliant riser system.
Figure 13C:
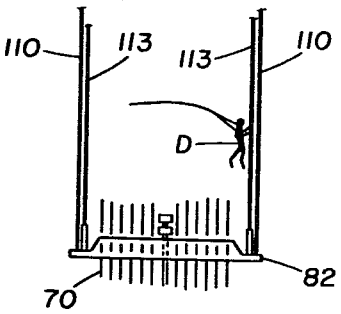
Figure 13B:
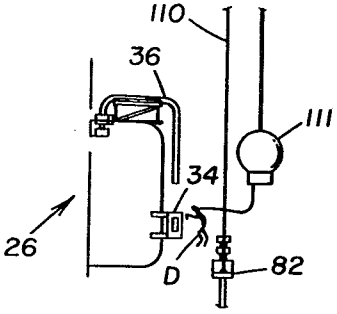
Figure 13A:
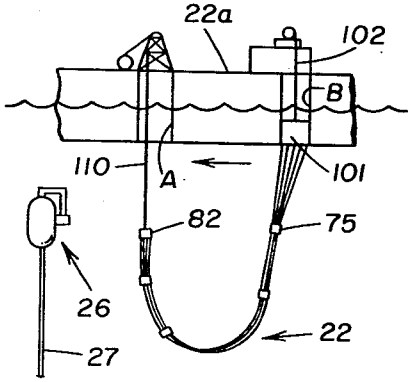

After flexible section 22 is assembled, rotary plug 101 is pulled into moonpool B of vessel 22*a* and affixed therein. Yoke 82 is lowered by means of lines 110 to a position just below yoke support arms 34 on buoy section 26 (FIG. 13B). Diver D exits diving bell 111 and attaches taglines 112 to guidelines 113. By means of winch 114 on buoy section 26 and taglines 112, diver D pulls guidelines 113 into guide shoes 115 which are split or hinged to allow lines 113 to enter. Slack is then taken up on lines 113 to draw yoke 82 into position on yoke support arms 34. As yoke 82 is drawn upward, upper support 87*a* of connecting pin assembly 87 passes through slots 34*a* on support arms 34. Hydraulic cylinders 87*b* are then actuated to move crossbar 87*c* into engagement between upper support arms 34 thereby locking yoke 82 in position on buoy section 26. Cylinders 98 are then actuated to move connector 90 into engagement with male end 45 of gooseneck conduit 36 and connector 90 is actuated to secure the connection between gooseneck conduit 36 and flexible conduit 70. Diver D then makes up the electrical connection between cables 41*a* and 70*a* to complete the installation.

Alternatively, the conduits can be assembled into yoke 82 after it has been positioned in the water. This procedure can be employed for initial installation or replacement of flexible flow lines individually. This includes the steps of (1) guiding an upwardly-directed flexible flowline 70 with its termination onto a pivotal yoke-mounted loading gate, (2) securing the flowline termination on the loading gate 85 and closing the loading gate to lock the flexible flowline onto the gate, (3) aligning a rigid connector 36 over the flowline termination for operative connection therewith, the rigid connector being connected to the lower riser conduit 30 before or after flexible flowline installation; and (4) lifting the flowline termination upwardly into operative connection with the rigid connector by jack means 38 mounted between the flowline termination and the yoke assembly. This technique establishes fluid communication from the subsea well through the fixed riser section and flexible flowline to the surface facility with the flexible flowline depending from the rigid connector at substantially vertical catenary departure angle and with the flowline termination being substantially entirely supported by the rigid connector.

What is claimed is:

1. In a marine compliant riser system wherein a catenary flexible flowline bundle is connected between a surface facility and a submerged lower riser section, the improvement which comprises:

a flexible flowline bundle having means for attaching a plurality of flexible conduits at a bottom portion of the surface facility for rotation relative to the surface facility, the conduits being attached thereto at radially disposed spaced attachment points and depending therefrom at a substantially vertical catenary angle of departure;

a plurality of spreader beams adapted for holding the flexible conduits in parallel spaced-apart relationship and comprising guide means for loosely retaining each of said flexible conduits in substantially linear array while permitting longitudinal movement thereof;

means for maintaining the spreader beams longitudinally spaced along the flowline bundle; and means for connecting the parallel-spaced conduits at a substantially vertical catenary departure angle to corresponding points on the submerged lower riser section in linear array to establish fluid communication through the rigid riser section and flexible flowline.

2. The riser system of claim 1 wherein the catenary flowline bundle comprises a plurality of substantially equal length conduits forming a ribbon-like catenary.

3. The riser system of claim 1 wherein the spreader beams are held by beam-end wires attached to the surface facility and a yoke assembly mounted at a top portion of the rigid riser section, whereby the wires support substantially only the spreader means while permitting the flexible conduits to assume a catenary shape.

4. The riser system of claim 1 wherein the flexible flowline bundle comprises disparately-sized conduits, and wherein larger conduits are disposed at a center portion of the linear flowline bundle array and smaller conduits are disposed towards peripheral portions of the linear array.

5. The riser system of claim 1 wherein said flexible flowline bundle comprises a plurality of substantially round flexible conduits.

6. The riser system of claim 5 wherein the spreader guide means comprises annular openable means for loosely retaining corresponding conduits and having an inside diameter permitting at least 25% conduit diameter clearance.

7. The riser system of claim 6 wherein flexible conduits have terminal connection means for attachment to the rigid riser section, said connection means being sufficiently small to permit pulling through the spreader guide means.

8. The riser system of claim 1 wherein the flexible flowline bundle is attached to a floating vessel surface facility through a rotary moonpool plug to permit rotation of the floating vessel while maintaining orientation of the bundle.

9. The riser system of claim 1 including at least one hydraulic power and electrical power umbilical line.

10. The riser system of claim 1 wherein the spreaders have individually-operable conduit guides permitting removal and insertion of individual conduits.

11. The riser system of claim 1 wherein said conduits from the linear array are attached to the surface facility in a circular array.

12. A marine compliant riser system for connecting a subsea hydrocarbon source to a floating surface facility through a lower multi-conduit riser section to a submerged buoy section located below a turbulent water zone and a flexible flowline comprising: a plurality of flexible conduits for fluid connection between corresponding lower riser conduits and the surface facility;

connection assembly means for connecting upwardly-directed flexible conduits with corresponding upwardly-directed lower riser conduits in fluid flow relationship;

a yoke assembly mounted on the buoy section, including beam means for holding a plurality of spaced apart flexible conduit terminations;

each of said flexible conduits being connected individually in catenary arrangement between the yoke assembly and the surface facility, said flexible conduits being attached to the surface facility in compact, non-linear array and to the yoke assembly in substantially linear array; and a plurality of spreader beams spaced longitudinally along the flexible flowline at predetermined locations, each of said spreader beams having annular conduit guide means mounted on the beam in laterally-spaced linear array for restraining the conduits from side movement while permitting longitudinal movement of individual conduits axially with the flowline.

* * * * *